US009164487B1

(12) United States Patent
Raggi et al.

(10) Patent No.: US 9,164,487 B1
(45) Date of Patent: Oct. 20, 2015

(54) STRIKING WATCH

(71) Applicant: Société anonyme de la Manufacture d'horlogerie Audemars Piguet & Cie, Le Brassus (CH)

(72) Inventors: Lucas Raggi, St-Blaise (CH); Jean-Daniel Lüthi, Russy (CH); José Manuel Fernandez, Le Brassus (CH)

(73) Assignee: Société anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 0 days.

(21) Appl. No.: 14/703,940

(22) Filed: May 5, 2015

(30) Foreign Application Priority Data

May 7, 2014 (EP) ..... 14167306

(51) Int. Cl.
*G04B 21/02* (2006.01)
*G04B 21/08* (2006.01)
*G04B 23/02* (2006.01)

(52) U.S. Cl.
CPC ..... *G04B 21/02* (2013.01); *G04B 21/08* (2013.01); *G04B 23/028* (2013.01)

(58) Field of Classification Search
CPC ..... G04B 21/02; G04B 21/06; G04B 21/08; G04B 23/026; G04B 23/028
USPC ..... 368/75, 244, 267–271
See application file for complete search history.

(56) References Cited

U.S. PATENT DOCUMENTS

| | | | | |
|---|---|---|---|---|
| 2,786,326 | A | 3/1957 | Junghans et al. | |
| 4,258,432 | A * | 3/1981 | Zafferri et al. | 368/250 |
| 8,540,420 | B2 | 9/2013 | Morata et al. | |
| 2007/0140067 | A1 * | 6/2007 | Greubel et al. | 368/260 |
| 2008/0165630 | A1 * | 7/2008 | Candaux | 368/243 |
| 2011/0228647 | A1 | 9/2011 | Karapatis et al. | |
| 2012/0140602 | A1 | 6/2012 | Favre et al. | |
| 2012/0140603 | A1 | 6/2012 | Sarchi et al. | |

FOREIGN PATENT DOCUMENTS

| | | | |
|---|---|---|---|
| CH | 263861 | A | 9/1949 |
| EP | 2 207 069 | A2 | 7/2010 |
| EP | 2 367 078 | A1 | 9/2011 |
| EP | 2 196 869 | B1 | 5/2012 |
| EP | 2 461 219 | A1 | 6/2012 |
| EP | 2 461 220 | A1 | 6/2012 |
| EP | 2 228 693 | B1 | 3/2013 |
| FR | 2 777 095 | A1 | 10/1999 |

* cited by examiner

*Primary Examiner* — Vit W Miska
(74) *Attorney, Agent, or Firm* — Drinker Biddle & Reath LLP

(57) ABSTRACT

A striking watch including a watch case delimiting an internal chamber, as well as the insert partition defining an acoustic sound emission membrane, the insert partition divides the internal chamber into an acoustic cavity and a tight housing which receives a timepiece movement and a gong provided to vibrate after having received an impact from a striking mechanism associated with the timepiece movement, and the acoustic cavity is delimited at least by the insert partition and by a back cover, and the insert partition bears the gong.

14 Claims, 3 Drawing Sheets

STRIKING WATCH

CROSS-REFERENCE TO RELATED APPLICATIONS

The present patent application claims priority to European Patent Application No. 14167306.1 filed on May 7, 2014, the entire contents of which are herewith incorporated by reference

TECHNICAL FIELD OF THE INVENTION

The present invention is related to a striking watch or a watch that can generate sounds emissions by mechanical means.

STATE OF THE ART

In the field of horology it is known to equip a watch with a striking work intended to produce one or more sounds, for example at regular intervals, as in the case of a large striking work, or following a manual actuation, as in the case of a minute repeater or a quarter repeater or at a settable time in the day, in the case of an alarm clock.

The sound can result from the setting in vibration of a gong following its being struck by a hammer. The gong is generally made up of an elongated element in the shape of a portion of a ring, which partially encircles the timekeeping movement of the watch inside the watch-case. A plurality of gongs can at the same time equip the same watch to produce different tones.

Produced from inside the watch-case, the sound vibrations must be audible outside this watch-case, which tends however to muffle them. In this regard, the more the watch is of reduced size, the more its components must be small and the more difficult it is to make them emit a sufficiently powerful sound. This poses problems in an acute way in wristwatches, for which the invention is more specifically intended.

When the timepiece movement is disposed inside a tight housing, the same applies to the gong or gongs, except if a complex device is provided to transmit an impact through one of the walls delimiting the tight housing. The attenuation of the vibration waves is accentuated by the presence of gaskets at the interfaces between the pieces delimiting the tight housing.

The acoustical intensity of a sound is only one of its aspects. A sound likewise stands out by its sonorousness or timbre, resulting in several factors, among which are the structure of harmonics and of partial tones in the sound and the evolution of this structure in time. In the sense meant here, the quality of a sound comprises its intensity as well as its other aspects, in particular its sonorousness or timbre.

Proposed in the European patent EP 2 196 869 B1 is a watch-case equipped with a gong holder and a gong, which are integral with a middle of the watch-case. Such a middle is particularly complex to achieve without so much as guaranteeing that the sound emitted by the watch has the expected qualities, in particular a satisfactory sonorousness.

The European patent EP 2 228 693 B1 proposes a solution in which the gong is fixed to the crystal of the watch-case. The fixation device for the gong is complex. Moreover, it can be feared that, here too, the sonorousness of the sound emitted by the watch is not satisfactory.

In the French patent application FR 2 777 095, it is a question of watches in which the middle is at least partially hollow in such a way as to contain one or more resonant chambers. The gong or another resonating element is fixed to a wall delimiting such a resonant chamber which extends inside the watch-case. The middle containing the resonant chamber is a complex part difficult to achieve. Moreover, the walls delimiting the resonant chamber are made of a material which must be the same as that of all or part of the middle and thus cannot be selected solely for its acoustic properties.

Described in the patent applications EP 2 367 078 A1, EP 2 461 219 and EP 2 461 220, is a watch provided with an acoustic radiating membrane forming a separating partition inside the watch-case. On one side of this membrane is located the timepiece movement including the bottom plate. The support bearing the gong is fixed to the plate of the timepiece movement to which the vibrations of the gong are thus transmitted.

Proposed in the Swiss patent CH 263861 is a watch provided with an acoustic membrane which forms the insert partition inside the watch-case and which bears an element in the form of a bell provided to vibrate after having been struck by a hammer.

SUMMARY OF INVENTION

According to one aspect of the present invention, a striking watch is provided. The striking watch preferably includes a timepiece movement, a striking mechanism associated with the timepiece movement, a gong for vibrating after having received an impact from the striking mechanism, and a watch case delimiting an internal chamber and having a back cover. Moreover, the striking watch further preferably includes an insert partition that has a peripheral border forming a connecting flange connecting the insert partition to the watch case, and a central portion forming an acoustic sound emission membrane, the insert partition dividing the internal chamber of the watch case into an acoustic cavity and a tight housing receiving the timepiece movement, the striking mechanism and the gong, the acoustic cavity being delimited at least by the insert partition and by the back cover, the insert partition bearing the gong. Moreover, the striking watch also preferably includes a fixation element for fixing the gong to the insert partition, the fixation element being located at a portion connecting a border of the acoustic sound emission membrane to the connecting flange.

One object of the features of the invention is to permit improvement of the sound qualities of a striking work incorporated in a watch, by means of as simple a solution as possible.

In the sense understood here, mechanical vibrations are vibrations occurring and being propagated in the solid material. In a watch incorporating at least one aspect of the present invention, the mechanical vibrations of the gong are transmitted to the acoustic sound emission membrane, which vibrates as a result and which emits sound waves adding to those emitted by the gong. This permits a quality of sound to be obtained, the parameters of which can be modified making use of features of the acoustic sound emission membrane.

The striking watch defined further above can incorporate one or more other advantageous features, by themselves or in combination, in particular from among those defined in the following.

Preferably, the fixing of the gong to the insert partition is a rigid, vibration-conducting fixing. When such is the case, the transmission of the mechanical vibrations of the gong to the acoustic sound emission membrane is efficient.

Preferably, the rigid, vibration-conducting fixing alone holds the gong. When such is the case, there is only little damping of the vibrations of the gong without sound emission.

Preferably, the rigid, vibration-conducting fixing is achieved by a fixing device comprising a block which rigidly holds the gong and which is rigidly fixed to the insert partition.

Preferably, the block comprises a face pressed on a surface of the insert partition. When such is the case, the transmission of the mechanical vibrations of the gong to the acoustic sound emission membrane is efficient.

Preferably, the insert partition comprises a mounting base to which the gong is mounted.

Preferably, there is a local junction of the mounting base with the border of the acoustic membrane.

Preferably, the connecting flange extends in a plane spaced apart from the acoustic sound emission membrane. Preferably an endless wall of the insert partition connects the acoustic sound emission membrane to the connecting flange.

Preferably, a local thickening of the endless wall forms the mounting base.

Preferably, the fixing of the gong to the insert partition is located at the endless wall.

Preferably, the acoustic sound emission membrane, the rigid vibration-conducting fixing, and the gong are spaced apart from any member distinct from the insert partition. When such is the case there is little if any loss of vibrations of the gong in an element not involved in the sound emission.

Preferably, the striking watch comprises a gasket disposed between the connecting flange and the watch-case in such a way as to achieve a sealing between the tight housing and the acoustic cavity.

Preferably, at least one through hole for sound diffusion connecting the acoustic cavity with the outside is pierced into the said back cover.

Preferably, the acoustic sound emission membrane is such that the vibration of this acoustic sound emission membrane is favoured at at least some of the frequencies at which the gong is able to vibrate, following a received impact.

BRIEF DESCRIPTION OF DRAWINGS

Other advantages and features become more clearly evident from the description which will follow of a particular embodiment of the invention given by way of non-limiting example and represented in the attached drawings, in which.

DESCRIPTION OF A PREFERRED EMBODIMENTS

Figure 1:
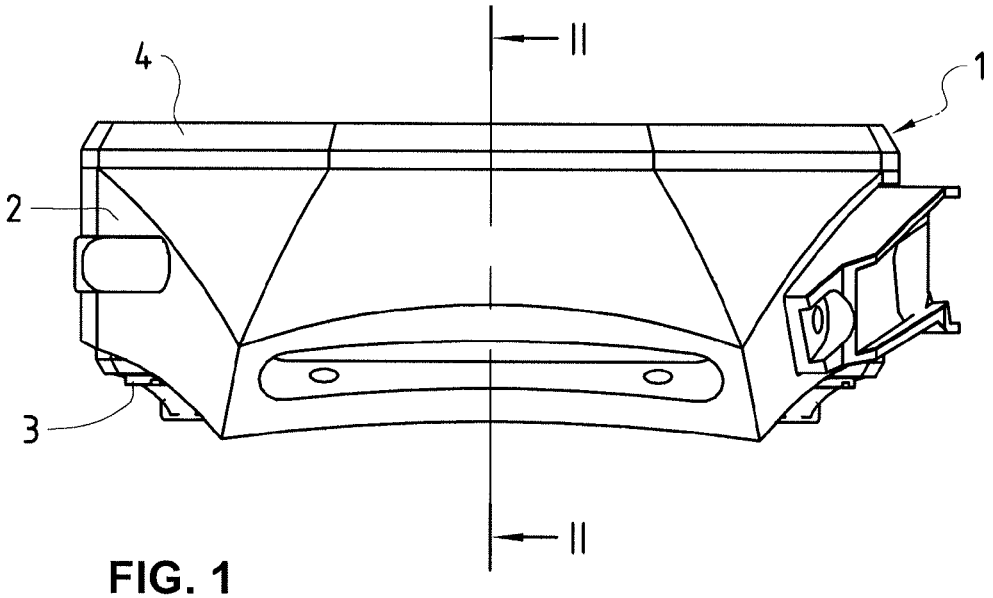
FIG. 1 is a lateral view in which a wristwatch according to the invention is represented without its wristband.

In FIG. 1, a watch according to the invention comprises a watch-case 1 resulting from the assembly of a plurality of pieces which are a middle 2, a back cover 3 and a bezel 4.

Figure 2:
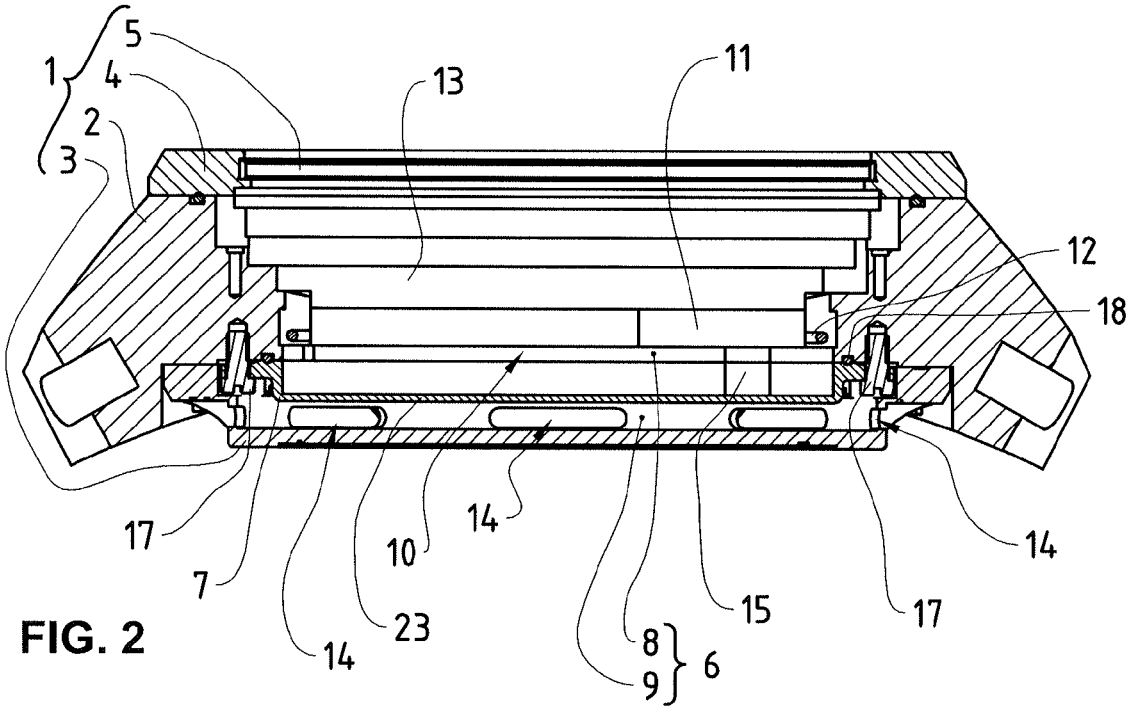
FIG. 2 is a simplified view which represents the same watch according to the invention as FIG. 1 and where certain parts just of this watch are represented in section along the line II-II of FIG. 1, whereas the internal subassemblies known in themselves of the watch of FIG. 1 are represented schematically or omitted in the interest of clarity.

As can also be seen in FIG. 2, the watch-case 1 likewise comprises gaskets and a crystal 5 held by the bezel 4. The constituent parts of the watch-case 1 are held together by fixation means known per se and not visible in the figures.

The watch-case 1 delimits an internal chamber 6, which an insertion partition 7 divides into two superimposed spaces which are a closed and tight housing 8 and an acoustic cavity 9. In the tight housing 8 are found a timepiece movement 10 and a striking mechanism 11 associated with this timepiece movement 10. A gong 12 is likewise present in the tight housing 8. Although there is only a single gong 12 in the example represented, it is possible to provide a plurality of gongs without departing from the scope of the invention.

Made up of a portion of a torus, the gong 12 is an element elongated and curved in a uniform way over substantially its entire length. It runs along the middle 2 and surrounds at least partially the timepiece movement 10.

The timepiece movement 10 and the striking mechanism 11 are known per se and are represented schematically, as is likewise the bottom plate 13 of the timepiece movement 10. The striking mechanism 11 is provided to strike the gong 12 and thus to make it vibrate, for example one or more times at regular intervals, every hour, or after manual actuation, or at a settable moment in the day, in the case of an alarm.

The back cover 3 and the insert partition 7 delimit between them the acoustic cavity 9, which is flattened in the direction of the thickness of the watch and which through holes for sound diffusion 14 connect with the outside. As a variant, the back cover 3 of the watch-case 1 can be devoid of through holes for sound diffusion 14, a striking watch being able to incorporate the invention even if no hole for sound diffusion 14 has been pierced in the back cover of its case.

Figure 3:
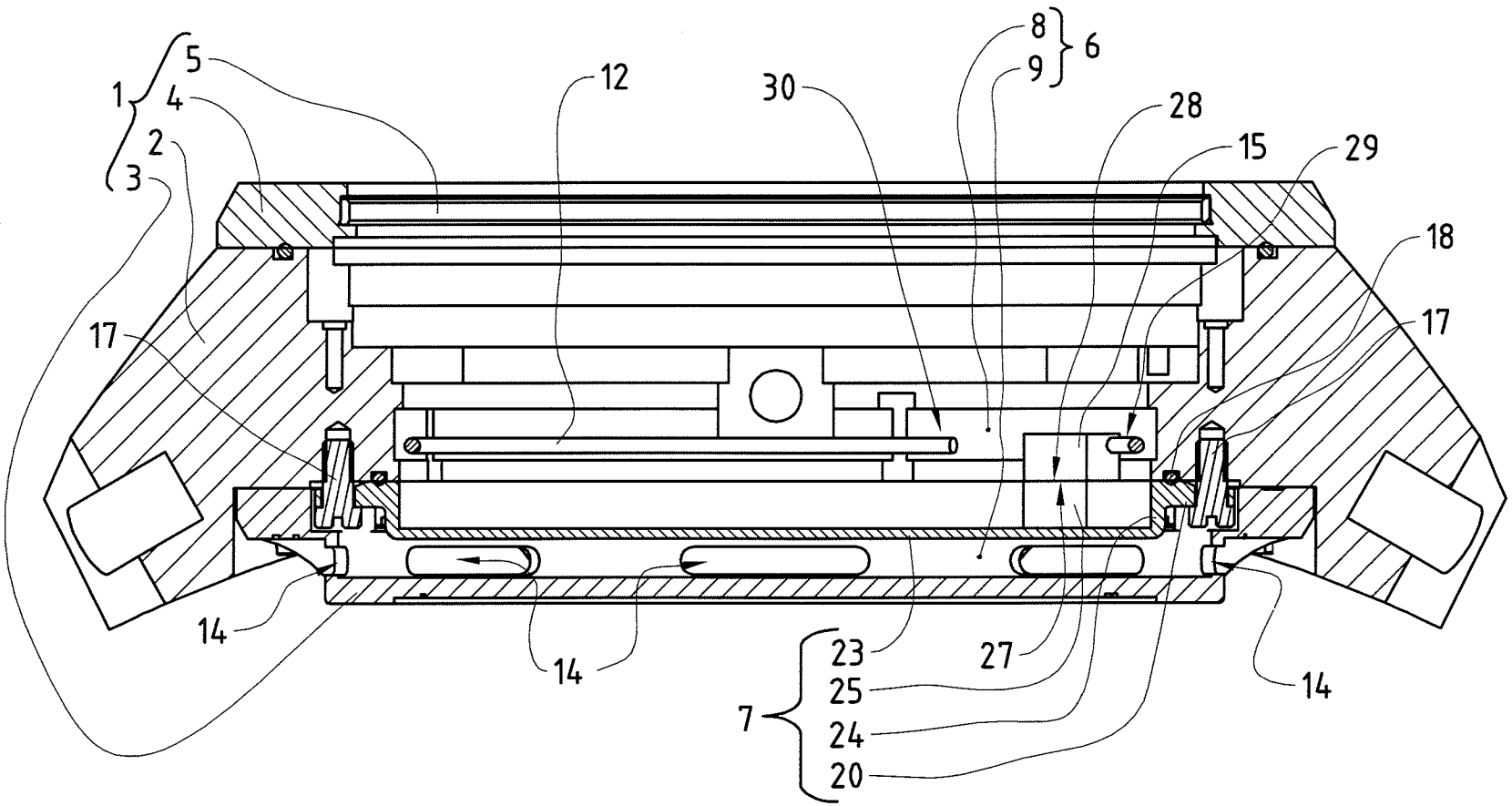
FIG. 3 is a simplified view which likewise represents the same watch according to the invention as FIG. 1 and which is identical to FIG. 2 except in that the movement of the watch and a striking mechanism have been left out.

As can be seen in FIG. 3, the gong 12 is mounted in the tight housing 8, independently of the timepiece movement 10 and of the striking mechanism 11, which have been removed in FIG. 3. In particular, the gong 12 is not fixed to the bottom plate 13. This gong 12 is fixed to the insert partition 7 via a block 15, which is metallic like the gong 12.

The insert partition 7 is distinct from the watch-case 1. This insert partition 7, the gong 12 and the block 15 form part of a subassembly 16, which can be assembled prior to its mounting in the watch-case 1, then be fixed in this watch-case 1, at the middle 2, with the aid of a set of screws 17. The insert partition 7 and the middle 2 press between them a gasket 18, which participates in the tightness of the tight housing 8 with respect to the outside. The subassembly 16 is such that its presence does not affect the tightness of the watch.

Figure 4:
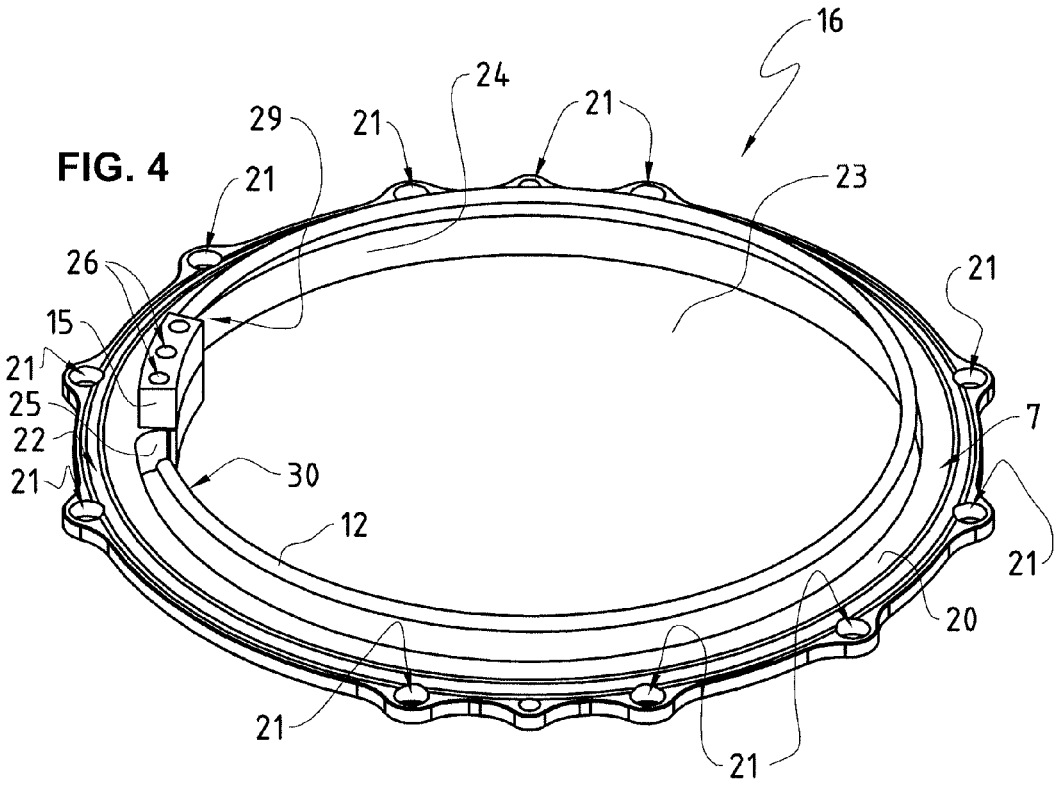
FIG. 4 is a view in perspective of a subassembly belonging to the watch of FIGS. 1 to 3 and comprising a gong held by a fixation block and the insert partition of which the central part constitutes an acoustic membrane.
Figure 5:
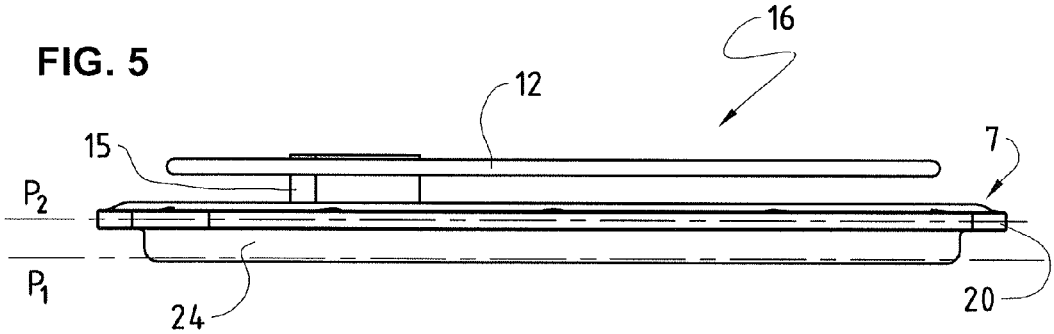
FIG. 5 is a lateral view representing the same subassembly as FIG. 4.

The subassembly 16 is represented only in FIGS. 4 and 5. The insert partition 7 of this subassembly 16 has overall the shape of a dish with lip. It comprises a peripheral border forming a connecting flange 20, which is provided with distributed holes 21, each for the passage of a screw 17. A face of the connecting flange 20 delimits an annular groove 22 for positioning of the gasket 18.

A central portion of the insert partition 7 constitutes a flat acoustic membrane for sound emission 23, which a rising endless wall 24 connects to the connecting flange 20. As can be well seen in FIG. 5, the flat acoustic membrane for sound emission 23 extends in a plane $P_1$, while being offset by a plane $P_2$ in which extends the connecting flange 20. As can be seen in FIG. 4, a protuberance resulting from a local thickening, toward the inside, of the rising wall 24 forms a mounting base 25 where the block 15 is mounted. This mounting base 25 connects locally to the border of the acoustic membrane for sound diffusion 23. The insert partition 7, including its acoustic sound emission membrane 23, can be made of metallic glass, for example, or of titanium or of steel or even of a cuprous metal. The acoustic sound emission membrane 23 can also be complex and be made up of a plurality of associated elements. Its constituent material can be a composite material.

The block 15 is rigidly fixed to the insert partition 7, by metallic screws known per se and not visible, which pass into holes 26 of the block 15 and which are screwed on the mounting base 25. As can be seen in FIG. 3, a flat face 27 of the block 15 is pressed tightly on a complementary flat surface 28 of the mounting base 25, in such a way that the transmission of mechanical vibrations from the block 15 to the insert partition 7 is favored.

In a variant, the block 15 can be fixed rigidly to the partition 7 by soldering.

Only the block 15 holds the gong 12. More precisely, it holds rigidly a fixed end 29 of the gong 12, whose other end 30 is free. The fixed end 29 is force-fitted into a hole of the block 15, in such a way as to be rigidly integral with this block 15. The gong 12 is held solely by its fixed end 29.

The block 15 and the screws which fix it to the mounting base 25 achieve a rigid fixing of the gong 12 to the insert partition 7. This rigid fixing is a conductor of mechanical vibrations.

The striking mechanism 11 is provided to apply an impact on the gong 12 in the vicinity of the fixed end 29. Following such an impact, the gong 12 begins to vibrate. Once it vibrates, the gong 12 emits sound waves into the air surrounding it. In addition, the block 15 transmits the mechanical vibrations of the gong 12 to the insert partition 7. Mechanical vibrations generated by the gong 12 are thus transmitted to the acoustic sound emission membrane 23, which likewise beings to vibrate and which likewise emits sound waves, in particular into the air of the acoustic cavity 9.

In this way, the emission of sound starting from vibrations of the gong 12 takes place at this gong 12 and also at the acoustic sound emission membrane 23, which acts in the manner of a sounding board without just transmitting sound vibrations.

The specifications of the acoustic sound emission membrane 23, in particular its constituent material, its geometry and its dimensions, are selected to favor the vibration of this acoustic membrane for sound emission 23 at all or some of the frequencies, including the partial tones, at which the gong 12 is able to vibrate following a received impact or after having been struck. The sound emitted by the gong 12 and the acoustic sound emission membrane 23 is of excellent quality, as much in terms of acoustic intensity as in sonorousness or richness of sound.

In this regard it will be noted that it is not possible to select with the same freedom the vibratory properties of a crystal of a watch-case. In particular such a crystal must have a large thickness to be sufficiently resistant so that its first natural resonant mode is situated normally around 16 kHz, that is to say largely above the interesting zone which contains the partial tones of the gong and which is situated generally between 500 Hz et 1 kHz. This is why the solution proposed in the aforementioned European patent EP 2 228 693 B1 cannot be satisfactory from the viewpoint of sound quality, in contrast to the invention defined in the foregoing.

The holes for sound diffusion 14 diffuse to the outside the sound emitted in the acoustic cavity 9.

The invention claimed is:

1. A striking watch, comprising:

a timepiece movement;

a striking mechanism associated with the timepiece movement;

a gong for vibrating after having received an impact from the striking mechanism;

a watch case delimiting an internal chamber and having a back cover;

an insert partition including, a peripheral border forming a connecting flange connecting the insert partition to the watch case, and a central portion forming an acoustic sound emission membrane, the insert partition dividing the internal chamber of the watch case into an acoustic cavity and a tight housing receiving the timepiece movement, the striking mechanism and the gong, the acoustic cavity being delimited at least by the insert partition and by the back cover, the insert partition bearing the gong; and a fixation element for fixing the gong to the insert partition, the fixation element being located at a portion connecting a border of the acoustic sound emission membrane to the connecting flange.

2. The striking watch according to claim 1, wherein the fixation element is a rigid, vibration-conducting fixing.

3. The striking watch according to claim 2, wherein the rigid, vibration-conducting fixing alone holds the gong.

4. The striking watch according to claim 2, wherein the rigid, vibration-conducting fixing includes a fixing device comprising a block which rigidly holds the gong and which is rigidly fixed to the insert partition.

5. The striking watch according to claim 4, wherein the block comprises a face pressed on a surface of the insert partition.

6. The striking watch according to claim 1, wherein the insert partition comprises a mounting base to which the gong is mounted.

7. The striking watch according to claim 6, further comprising a local junction of the mounting base with the border of the acoustic sound emission membrane.

8. The striking watch according to claim 1, wherein the connecting flange extends in a plane spaced apart from the acoustic sound emission membrane, the insert partition further including an endless wall connecting the acoustic sound emission membrane to the connecting flange.

9. The striking watch according to claim 6, wherein the endless wall has a local thickening that forms the mounting base.

10. The striking watch according to claim 8, wherein the fixing of the gong to the insert partition is located at the endless wall.

11. The striking watch according to claim 1, wherein the acoustic sound emission membrane, the fixation element, and the gong are spaced apart from elements that are distinct from the insert partition.

12. The striking watch according to claim 1, further comprising a gasket disposed between the connecting flange and the watch case in such a way as to achieve a sealing between the tight housing and the acoustic cavity.

13. The striking watch according to claim 1, further comprising a through hole for sound diffusion and connecting the acoustic cavity with the outside, the through hole pierced into the back cover.

14. The striking watch according to claim 1, wherein the acoustic sound emission membrane is configured to favor at least some of the frequencies at which the gong is able to vibrate, following a received impact.

* * * * *